US006672757B2

(12) United States Patent
Hallett, Jr.

(10) Patent No.: US 6,672,757 B2
(45) Date of Patent: Jan. 6, 2004

(54) BLENDER ADAPTER FOR AN OUTBOARD MOTOR

(76) Inventor: Barry J. Hallett, Jr., 57 Quarry St., Gloucester, MA (US) 01939

( * ) Notice: Subject to any disclaimer, the term of this patent is extended or adjusted under 35 U.S.C. 154(b) by 343 days.

(21) Appl. No.: 09/732,746

(22) Filed: Dec. 11, 2000

(65) Prior Publication Data

US 2002/0071341 A1 Jun. 13, 2002

Related U.S. Application Data

(60) Provisional application No. 60/224,539, filed on Aug. 11, 2000.

(51) Int. Cl.[7] ..... B01F 7/16

(52) U.S. Cl. ..... 366/199; 366/205; 366/314; 440/49; 440/113; 440/900; 241/101.2; 241/101.74; 241/282.2

(58) Field of Search ..... 366/199, 200, 366/205, 314, 349, 197; 440/49, 113, 900; 241/277, 282.1, 282.2, 101.2, 101.71, 101.74

(56) References Cited

U.S. PATENT DOCUMENTS

| | | | | |
|---|---|---|---|---|
| 1,738,772 | A | * | 12/1929 | Harry |
| 2,549,480 | A | * | 4/1951 | Kiekhaefer |
| 2,632,635 | A | * | 3/1953 | Guilder |
| 3,812,379 | A | * | 5/1974 | Kaufman et al. |
| 4,010,377 | A | * | 3/1977 | McKenzie |
| 5,006,086 | A | * | 4/1991 | Latham |
| 6,283,808 | B1 | * | 9/2001 | Lehmann |

* cited by examiner

*Primary Examiner*—Charles E. Cooley
*Assistant Examiner*—David Sorkin
(74) *Attorney, Agent, or Firm*—Duane Morris LLP

(57) ABSTRACT

A system and method for operating an auxiliary device from an internal combustion engine driven tool without materially affecting the primary function of the tool. The system and method is particularly useful for operating a blender from an outboard motor.

7 Claims, 3 Drawing Sheets

BLENDER ADAPTER FOR AN OUTBOARD MOTOR

This application claims the benefit of provision application No. 60/224,539, filed Aug. 11, 2000.

BACKGROUND

The present invention relates to an outboard motor blender.

Portable blenders powered by an internal combustion engine are well known. One such portable blender is described in Reeder U.S. Pat. No. 5,938,329 dated Aug. 17, 1999. It is also known to convert the internal engines of small tools such as a string trimmer to be the power source for a portable blender. However, such portable blenders are single purpose tools.

There are many occasions where it is desirable to use an existing tool as the power source for a blender without disabling or in any way interfering with the primary purpose of the tool. By way of example, it is highly desirable to use portable lawn tools such as a string trimmer or lawn mower, or marine outboard motors or snowmobiles as the power source for a blender. In this way, a separate piece of single purpose equipment is not required, and the blender becomes readily available, e.g., to those performing or having completed yard work and/or to those enjoying boating activities or having rafted up with other boats upon return to the marina.

Accordingly it is an object of the present invention to provide a novel system and method for powering an auxiliary device such as a blender from the internal combustion engine of a preexisting tool without affecting the primary function of the tool.

It is another object of the present invention to provide a novel outboard motor blender and method in which a conventional marine outboard motor may be easily adapted as the power source for a blender.

It is yet another object of the present invention to provide a novel outboard motor with an adaptor for auxiliary devices.

It is still another object of the present invention to provide a novel adaptor for the internal combustion engine of a portable tool.

These and many other objects and advantages of the present invention will be readily apparent to one skilled in the art to which the invention pertains from a perusal of the claims, the appended drawings, and the following detailed description of the preferred embodiments.

DESCRIPTION OF THE PREFERRED EMBODIMENTS

Figures 1, 1A:
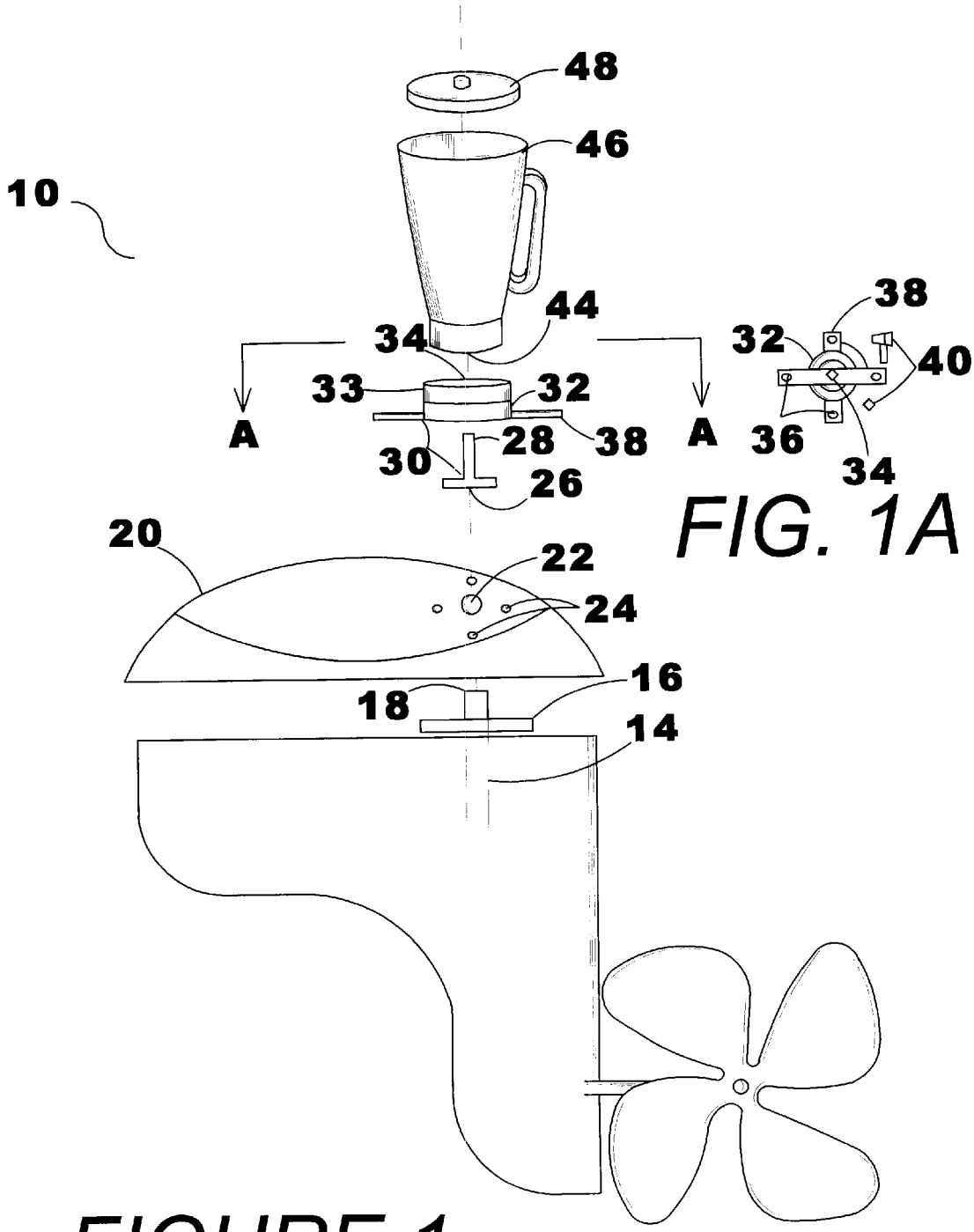
FIG. 1 is an exploded pictorial view of one embodiment of the outboard motor blender of the present invention in which the connector between the motor and the blender is removable with the blender.
FIG. 1A is a top plan view taken through lines A—A of FIG. 1.

Referring to FIG. 1, the system 10 for operating a blender 46 from an outboard motor 12 without materially affecting the primary function of the motor 12 includes an adapter 30 which may be removably attached to the shaft 14 or flywheel 16 of the motor 12 which may be any suitable conventional marine outboard motor, e.g., a one horsepower to a 250 horsepower motor.

The outboard motor 12 may include a housing or cover 20 removable from the motor 12 to allow access to the motor shaft 14 and/or flywheel 16. The cover 20 may be modified to include a shaft aperture 22 vertically aligned with the motor shaft 14 and/or flywheel 16 through which the adapter 30 may be inserted. The cover 20 may include a plurality of adapter apertures 24 spaced from the shaft aperture 22.

The adapter 30 may have an upward facing coupler interface 34 adapted for operative connection to the coupler interface 44 of the blender container 46 and a downwardly facing shaft connection 26 for operative connection to the motor shaft 14 or flywheel 16. The operative connection between the motor shaft 14 and the adapter 30 may include the flywheel 16.

The adapter 30 may include a support 32 and a shaft 28. The support 32 and shaft 28 may be a unitary structure or may be separate components (as shown), and the connection may be any suitable conventional male and female connection. The support 32 may have an upwardly facing coupler interface 34 and an upwardly facing mounting ring 33. The mounting ring 33 may be of suitable size and shape to engage the base of the blender container 46 so that the blender container 46 may remain stationary during operation of the motor 12, and so that the coupler interface 44 of the blender container 46 may be precisely coupled to the upward facing coupler interface 34.

The adapter 30 may be removably attached to the cover 20 with the shaft connection 26 extending downwardly through the shaft aperture 22. Depending legs or suitable conventional fasteners 40 may be used to mate with the peripheral apertures 24 to hold the support 32 and blender container 46 stationary during operation of the motor 12. For example, the support 32 may include holes 36 through which the conventional fasteners 40 may be placed or depending legs may be snapped into the peripheral apertures 24. The support 32 may include projections 38 that extend outward from the center of the support 32 having holes 36 or depending legs at the ends thereof.

The downwardly facing shaft connection 26 may be operatively connected to the motor shaft 14, flywheel 16, coupling 18, or a tool coupler, for rotation therewith which will in turn rotate the upwardly facing coupler interface 34. The motor 12 or motor shaft 14 may have a coupling 18 at the upper end thereof for connection to the downwardly facing shaft connection 26, to an adapter shaft, or to the shaft of an auxiliary device. The coupling 18 may include the flywheel 16. The coupling 18 may include means for receiving the downwardly facing shaft connection 26, an adapter shaft, or the shaft of an auxiliary device when downwardly extended through the aperture 22 in the cover 20. The coupling 18 may include a shaft upwardly extending through the shaft aperture 22 in the cover 20 for connecting with an auxiliary device or blender container 46.

Some outboard motors 12 or engine tools may require modifications in order to operatively connect to the downward facing shaft connection 26. For example, a coupling 18 may be added to the motor shaft 14 by any suitable means, e.g., a bolt or extended shaft may be welded to the motor shaft 14 to provide a more accessible coupling 18 than provided by the motor shaft 14 alone. The coupling 18 may include the flywheel 16. The motor 12 may also be modified to include a tool coupler adapted to mate with the motor shaft 14 or flywheel 16. The tool coupler may include a tool coupler shaft to mate the adapter 30. The coupling or tool coupler may be designed to allow access to the motor 12, motor shaft 14, or flywheel 16 for routine maintenance or repairs.

Once the adapter 30 is removably attached to the cover 20 and/or the motor 12, the blender container 46 may be operatively connected to the support 32. The size of the blender container 46 may range from a one quart capacity to a multi-gallon capacity, with a five gallon capacity preferred. The blender container 46 may include upwardly facing rotating blades and a downwardly facing coupler interface 44.

After the blender 46 is operatively connected to the support 32, the motor 12 may be started and the motor shaft 14 and flywheel 16 will rotate, which will in turn rotate the downwardly facing shaft connection 26 and the upwardly facing coupler interface 34. The rotation of the upwardly facing coupler interface 34 will effect the rotation of the blender blades to blend the contents of the blender 46. It will be appreciated that the blender 46 does not materially affecting the primary function of the motor 12.

The adapter 30 may remain attached to the motor 12 when the blender 46 is not is use. A safety cap may be provided to cover the support 32 to prevent a person from coming in contact with the upwardly facing coupler interface 34 protruding through the cover 20. The motor 12 may be operated with only the adapter 30 attached. The attached adapter 30 does not materially affect the primary function of the outboard motor 12 during operation of the outboard motor 12. The adapter 30 may also be removed from the motor 12 and a safety cap with a plurality of downwardly extending legs adapted to mate with the plurality of adapter apertures 24 while covering the shaft aperture 22 may be placed over the cover 20 to protect the motor 12 from the elements when the adapter 30 is not attached thereto or individual safety caps may be provided for each aperture 22, 24.

Figures 2, 2A:
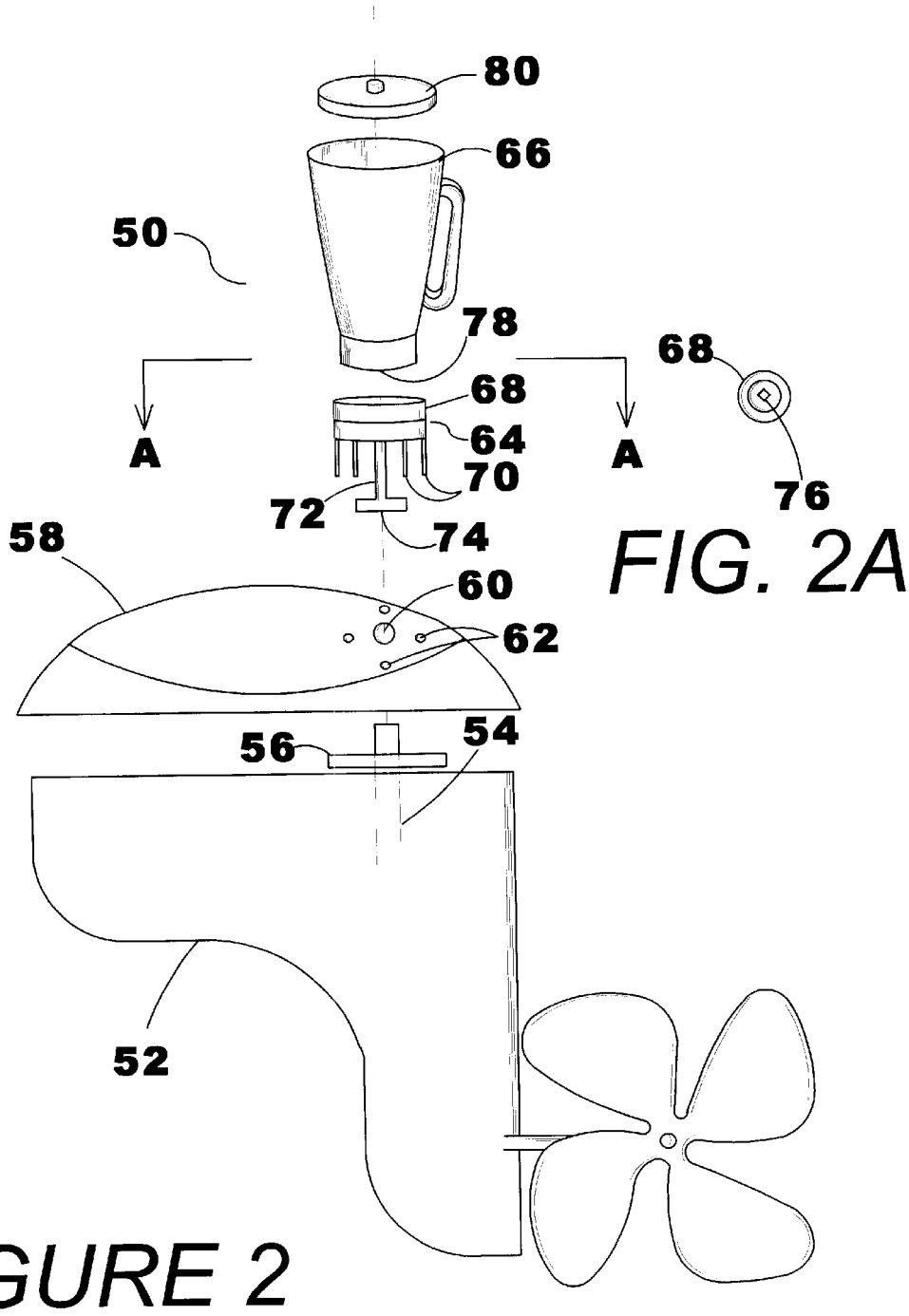
FIG. 2 is an exploded pictorial view of a second embodiment of the outboard motor blender of the present invention in which the connector is a permanent part of the blender.
FIG. 2A is a top plan view taken through lines A—A of FIG. 2.

FIG. 2 shows another embodiment of the claimed invention, where a blender 50 may be operated from a marine outboard motor 52 without materially affecting the outboard motor 52. The outboard motor 52 may have a vertically rotating shaft 54 and flywheel 56, and a cover 58. The cover 58 may be modified to include central aperture 60 aligned with the shaft 54 and plural peripheral apertures 62.

The blender 50 may comprise a base 64 and a removable container 66. The base 64 may have an upward facing mounting ring 66 to support the removable container 66 when operatively connected thereto. The removable container 66 may include upward facing blender blades and a downward facing coupler interface 78 for mating with the upward facing coupler 76 of the base 64.

The base 64 may have a central downwardly extending shaft coupler 74 and may have plural peripheral downwardly extending legs 70. The downwardly extending shaft coupler 74 may be located on the end of a shaft 72. The shaft 72 and base 64 may be a unitary structure or separate components, and the connection may be any suitable conventional male and female connection.

The blender 50 may be positioned on top of the cover 58 of the outboard motor 52 with the blender legs 70 mating with the peripheral apertures 62 to prevent the base 64 from rotating and with the shaft coupler 74 extending downwardly through the cover 58 into an operative connection with the motor shaft 54 or flywheel 56 for rotation therewith. Instead of legs 70, the base 64 may include holes through which attachment means may be placed to position the base 64 on the top of the cover 58 of the outboard motor 52 and vertically aligned with the motor shaft 54.

The shaft coupler 74 may be used to couple the motor 52 to the blender 50. The shaft coupler 74 may be operatively connected to the motor shaft 54, flywheel 56, motor coupling, or tool coupler, for rotation therewith. Once the shaft coupler 74 is operatively connected to the motor 52, the removable container 66 may be operatively connected to the base 64 so that the downwardly facing coupler interface 78 of the removable container 66 couples with the upwardly facing coupler 76 of the base 64. The base 64 may hold the removable container 66 stationary during blending. The motor 52 may then be operated which will in turn rotate the shaft coupler 74 and the upwardly facing coupler 76 of the base 64 to thereby cause the rotation of the blender blades within the removable container 66 to blend the contents therein.

The base 64 may remain operatively connected to the motor 52 when the removable container 66 is not attached thereto. A safety cap may be placed over the base 64 to shield the upwardly facing coupler 76 from any boat passengers. The operation of the motor 52 with only the base 58 operatively connected thereto will not materially affect the primary function of the motor 52 during operation of the motor 52.

Figures 3, 3A:
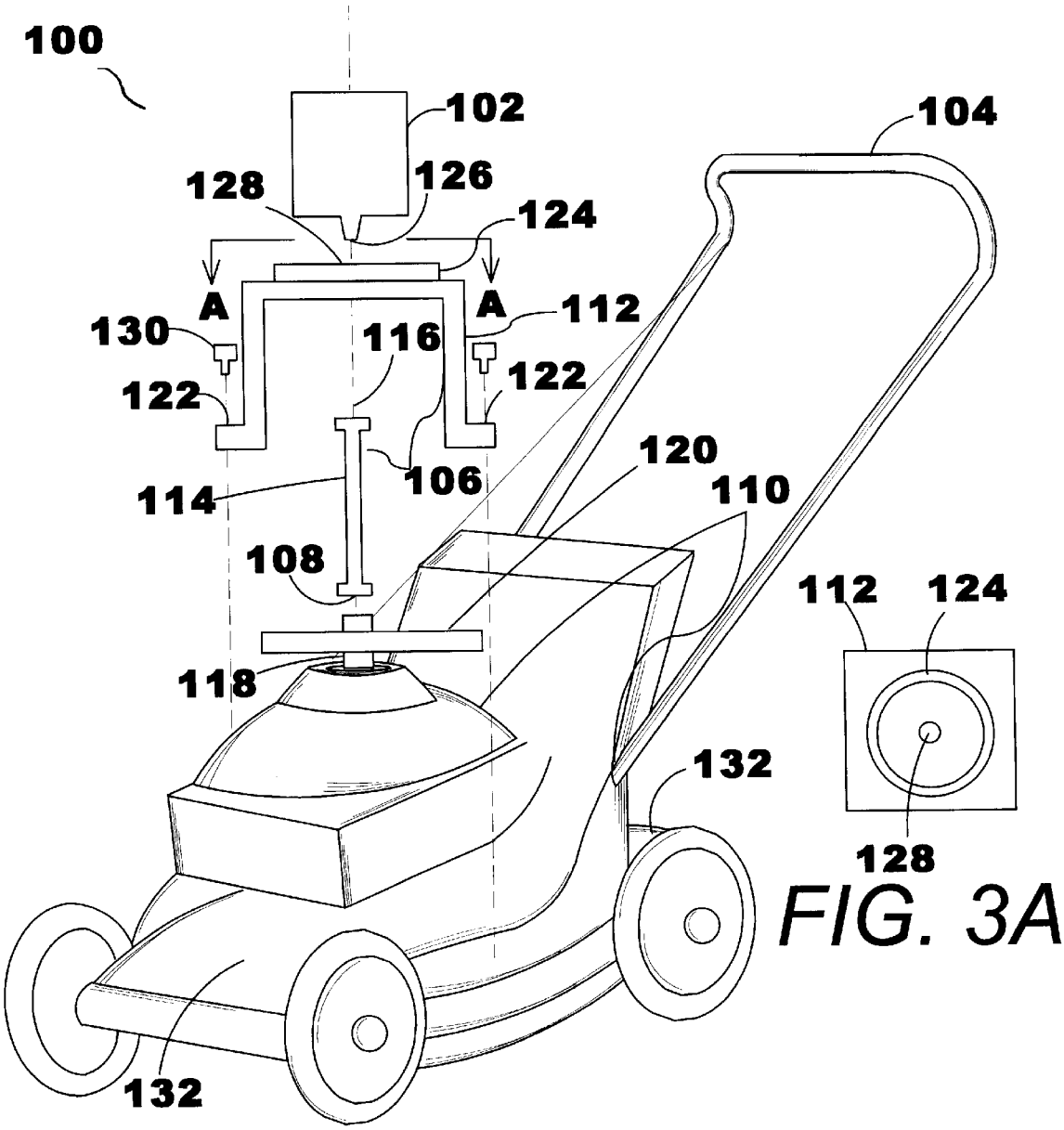
FIG. 3 is an exploded view of a third embodiment of the present invention illustrating an auxiliary device for a lawn mower.
FIG. 3A is a top plan view taken through lines A—A of FIG. 3.

FIG. 3 illustrates another embodiment of the claimed invention, including an adapter 106 for selectively providing power to an auxiliary device 102 from an internal combustion drive engine tool 104 without materially affecting the primary function of the tool 104. The tool 104 may be any tool having a rotating part to which an adapter 106 may mate, e.g., lawnmower or outboard motor. The tool 104 may include a cover 110 to which the adapter 106 may be removably attached. The cover 110 may be removable.

The adapter 106 may be adapted to mate with the tool 104. The adapter 106 may include an support 112 and a shaft 114. The support 112 may include a mounting ring 124 shaped to receive the base of the auxiliary device 102 and align the shaft 126 of the auxiliary device 102 with the tool shaft 118 or tool flywheel 120. The support 112 may be adapted to mate with the tool 104 in a manner which does not interfere with the performance of the primary function of the tool 104. The support 112 may be removably attached to the cover 110 by attachment means 130, and the support 112 and cover 110 may include holes 122, 132 through which conventional fasteners 130 may be placed.

The shaft 114 may be carried by the support 112. The support 112 and shaft 114 may be a unitary structure, and the connection may be any suitable conventional male and female connection. The shaft 114 may be adapted at one end 108 to mate with the tool shaft 118, flywheel 120, coupling or tool coupler. The other end 116 of the shaft 114 may be adapted to provide an operative connection to the adapter upwardly facing coupler 128.

The tool 104 may be modified to include a coupling. The coupling may include the fly wheel 120. The coupling may include means for receiving the downwardly facing end 108 of the shaft 114, the downwardly facing coupling of an adapter, or the shaft of an auxiliary device if extended downwardly through an aperture in the adapter. For example, the coupling may be a bolt or extended shaft attached to the tool shaft 118 to provide a more accessible coupling than provided by the tool shaft 118 alone or the coupling may include a shaft upwardly extending through a shaft aperture in the adapter for connecting with the downward facing coupler 126 of an auxiliary device 102. The tool may be modified to include a tool coupler adapted to mate with the tool 104, tool shaft 118, or flywheel 120. The tool coupler may include a tool coupler shaft adapted to mate the adapter 106. The coupling or tool coupler may be designed to allow access to the tool 104, flywheel 120 or tool shaft 118 for routine maintenance or repairs.

The upwardly facing coupler 128 may be adapted for operative connection to the downwardly facing coupler interface 126 of the auxiliary device 102 for rotation therewith. Rotation of the shaft 118 and flywheel 120 will in turn rotate the upwardly facing coupler 128 and the downwardly facing coupler 126. If the support 112 does not include an upwardly facing coupler, the end 116 of the shaft 114 may be operatively connected directly to the downwardly facing coupler 126 of the auxiliary device 102 for rotation therewith.

The auxiliary device 102 may be any device that may operate from a rotational power source such as a blender, alternator, drill, or generator. The auxiliary device 102 may be selectively installed on the adapter 106 so that the tool 104 may be operated with the auxiliary device 102 operatively connected to the adapter 106 or with only the adapter 106 removably attached to the tool 104. When only the adapter 106 is removably attached to the tool 104, the tool 104 may be operated and the adapter 106 will not materially affecting the primary function of the tool 102.

The auxiliary device 102 may be powered by the rotation of the shaft 118 or flywheel 120 of the tool 104. The auxiliary device 102 may be a system separate from the tool 104 that does not enhance the operation of the tool 104. For example, a blender operating from a lawnmower would not enhance the operation of a lawnmower. There is no requirement that the auxiliary device 102 support the primary function of the tool 104.

The auxiliary device 102 may be removably connected to the support 112 so that the downwardly facing coupler 126 of the auxiliary device 102 may couple to the upwardly facing coupler 128 of the adapter 106 and so that the auxiliary device 102 remains stationary during operation of the tool 104. The auxiliary device 102 may be removably connected to the support 112 by any suitable means, e.g. clamping, twisting, locking, bracketing, or bolting.

Once the adapter 106 is removably connected to the tool 102, and the auxiliary device 102 is removably connected to the adapter 106, the tool 102 may be started. Rotation of the tool shaft 118 and/or flywheel 120 will in turn rotate the shaft 114 attached thereto and the upwardly facing adapter coupler 128 and downwardly facing coupler 126 to provide power to the auxiliary device 102. The auxiliary device 102 may then operate without materially affecting the primary function of the tool 102.

When the tool 104 is turned off, the auxiliary device 102 may be removed from the adapter 106. The adapter 106 may remain attached to the tool 104 and the attached adapter 106 will not materially affect the primary function of the tool 104 during operation of the tool 104. A safety cap may be placed over the adapter 106 to prevent a person or object from contacting the upwardly facing coupler 128 which will rotate during the operation of the tool 104. When the adapter 106 is removed additional safety caps may be placed in the cover apertures 122 to protect the tool 102 from the elements.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A system for operating an auxiliary device from an internal combustion engine driven tool without materially affecting the primary function of the tool comprising:

an internal combustion engine having a driven propeller and having a rotating shaft;

an adapter removably connected to said rotating shaft; and a blender removably connected to said adapter, said blender being powered by the rotation of said shaft.

2. A system for operating a blender from an outboard motor without materially affecting the primary function of the motor comprising:

an outboard motor having a propeller and an upwardly extending, vertical rotating shaft and a motor cover with a shaft aperture vertically spaced from and aligned with said shaft;

a blender container including internal rotating blades and a downward facing coupler interface; and an adapter having an upwardly facing coupler interface adapted for operative connection to the coupler interface of said blender container and having a downwardly facing shaft connection adapted for operative connection to said shaft, said adapter being removably attached to said cover with said shaft connection extending downwardly through said shaft aperture in said cover into operative connection with the shaft of said outboard motor for rotation therewith so that the operation of said motor effects the rotation of said blender blades within said blender container when said adapter and said blender container are connected thereto.

3. The system of claim wherein 2 wherein said motor includes a flywheel; and wherein said operative connection between said motor shaft and said adapter includes the flywheel of said motor.

4. The system of claim 2 wherein said adapter includes a plurality of downwardly extending legs, said cover including a plurality of adapter apertures spaced from said shaft aperture, and the mating of said legs in said adapter apertures preventing the rotation of said blender container with said shaft.

5. The system of claim 4 including a safety cap with a plurality of downwardly extending legs adapted to mate with said adaptor apertures with said cap overlying said shaft aperture in said cover to protect said motor when said adapter is not attached thereto.

6. A system for operating a blender from an outboard motor without materially affecting the primary function of the motor comprising:

an outboard motor having a vertical rotating shaft and a motor cover with a shaft aperture vertically aligned with said shaft;

a blender container including internal rotating blades and a downward facing coupler interface; and an adapter having an upwardly facing coupler interface adapted for operative connection to the coupler interface of said blender container and having a downwardly facing shaft connection adapted for operative connection to said shaft, said adapter being removably attached to said cover with said shaft connection extending downwardly through said shaft aperture in said cover into operative connection with the shaft of said outboard motor for rotation therewith so that the operation of said motor effects the rotation of said blender blades within said blender container when said adapter and said blender container are connected thereto, said adapter including a plurality of downwardly extending legs, said cover including a plurality of adapter apertures spaced from said shaft aperture, the mating of said legs in said adapter apertures preventing the rotation of said blender container with said shaft.

7. The system of claim 6 including a safety cap with a plurality of downwardly extending legs adapted to mate with said adaptor apertures with said cap overlying said shaft aperture in said cover to protect said motor when said adapter is not attached thereto.

* * * * *